US007013992B2

(12) United States Patent
Tessari et al.

(10) Patent No.: US 7,013,992 B2
(45) Date of Patent: Mar. 21, 2006

(54) BOREHOLE STABILIZATION WHILE DRILLING

(75) Inventors: Robert M. Tessari, Calgary (CA); Tommy M. Warren, Coweta, OK (US); Per G. Angman, Calgary (CA); Maurice William Slack, Edmonton (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 10/460,662

(22) Filed: Jun. 13, 2003

(65) Prior Publication Data

US 2004/0045741 A1 Mar. 11, 2004

Related U.S. Application Data

(63) Continuation-in-part of application No. PCT/CA02/01114, filed on Jul. 18, 2002.

(51) Int. Cl.
*E21B 17/10* (2006.01)

(52) U.S. Cl. ..... 175/57; 175/325.2

(58) Field of Classification Search ..... 175/57, 175/325.1, 325.2, 325.5
See application file for complete search history.

(56) References Cited

U.S. PATENT DOCUMENTS

| | | | | |
|---|---|---|---|---|
| 2,262,211 A | | 11/1941 | Stone | |
| 3,067,593 A | | 12/1962 | McCool | |
| 4,135,588 A | | 1/1979 | Wagner | |
| 4,683,965 A | | 8/1987 | Walton et al. | |
| 4,819,747 A | | 4/1989 | Walton et al. | |
| 4,836,303 A | | 6/1989 | Boulet et al. | |
| 5,050,692 A | | 9/1991 | Beimgraben | |
| 5,065,826 A | | 11/1991 | Kruger et al. | |
| 5,293,945 A | * | 3/1994 | Rosenhauch et al. | 175/325.2 |
| 5,343,967 A | | 9/1994 | Kruger et al. | |
| 5,638,910 A | | 6/1997 | Noe et al. | |
| 5,857,531 A | | 1/1999 | Estep et al. | |
| 6,062,326 A | | 5/2000 | Strong et al. | |
| 6,158,531 A | | 12/2000 | Vail, III | |
| 2003/0079913 A1 | * | 5/2003 | Eppink et al. | 175/61 |

FOREIGN PATENT DOCUMENTS

| | | |
|---|---|---|
| EP | 0 816 628 A1 | 7/1998 |
| WO | WO 99/25949 | 5/1999 |

* cited by examiner

*Primary Examiner*—William Neuder
(74) *Attorney, Agent, or Firm*—Bennett Jones LLP

(57) ABSTRACT

A method for drilling in unconsolidated formation is taught. In particular, a method for borehole stabilization in an unconsolidated formation includes providing a drill string; rotating the drill string to drive a drill bit to drill a borehole having a borehole wall; driving the drill string against the borehole wall while rotating the drill string to plaster the surface of the borehole wall.

78 Claims, 5 Drawing Sheets

BOREHOLE STABILIZATION WHILE DRILLING

CROSS REFERENCE TO RELATED APPLICATIONS

This application is a continuation in part of applicant's corresponding PCT application PCT/CA02/01114, filed Jul. 18, 2002, designating the United States of America.

FIELD OF THE INVENTION

The present invention relates to a method and an apparatus for borehole drilling and in particular a method and an apparatus for stabilizing a borehole during the drilling process.

BACKGROUND OF THE INVENTION

Some oil-bearing formations, such as some of those found in Louisiana and Texas and in offshore waters of the Gulf of Mexico, are unstable including unconsolidated and/or thief formations. When drilling oil and gas wells borehole instability problems can occur including sloughing, stuck pipe and lost circulation. Thus, drilling in these formations can be difficult, expensive and time consuming.

Methods suggested for dealing with some of the problems with unstable formations including the use of lost circulation materials, cementing loss zones and setting casing through the zones. However, it remains a challenge to drill in unstable formations.

SUMMARY OF THE INVENTION

A method and an apparatus for drilling a borehole has been invented. In one embodiment, the method and the apparatus is useful for stabilizing the borehole wall when drilling through an unstable or loss zone. The method can improve borehole wall stability and reduce the risk of lost circulation, termed herein stabilization, which is desirable when drilling, especially in unconsolidated or thief formations.

In accordance with a broad aspect of the present invention the method includes providing a drill string including a drill bit connected at a distal end thereof and a pad carried by the drill string to move axially and rotationally with the drill bit; rotating the drill bit to drill a borehole, the borehole including a borehole wall; and driving the pad substantially continuously against the borehole wall while rotating the drill bit to apply a lateral wall stress load helically about the borehole wall.

In accordance with another broad aspect of the present invention, there is a borehole drilling apparatus comprising: a drill string; a drill bit connected at a distal end of the drill string; and a pad carried by the drill string to move axially and rotationally with the drill bit, the drill bit being rotatable to drill a borehole, the borehole including a borehole wall and the pad being drivable substantially continuously against the borehole wall to apply a lateral wall stress load helically about the borehole wall as it is moved with the drill bit.

The drill string can be formed of tubing, for example of a continuous length or formed of interconnected joints. In one embodiment, the drill string is a string of drill pipe connected by threaded pipe connections. Drill pipe is used for drilling the borehole and, once the borehole is complete, is often replaced with a borehole liner, which remains in the hole. In another embodiment, the drill string is a string of casing joints connected together for both drilling the borehole and thereafter, remaining down hole to line the borehole.

The bit can be selected based on various parameters and can include for example cone-type bits, fixed cutter bits with under reamers, etc. The drill bit can be driven by a mud motor or, in a preferred embodiment, by rotation of the drill string. In this preferred embodiment, the string rotation drives rotation of the bit and the pad is carried by the drill string to move rotationally and axially therewith. The drill string can be rotated by employing various means such as by use of a kelly, a top drive or other means. As will be appreciated, selection of the particular means for rotating the drill string is often dependent on the form of drill string being used.

The pad applies lateral wall stress load to the borehole wall as it is driven against the borehole wall and rotated and moved axially with the drill bit. The stress load causes compaction of the earthen materials exposed on the borehole wall and plasters materials against the borehole wall. Plastering mechanically works, as by crushing, applying and/or compacting borehole materials against, and into the porosity and fractures of, the borehole wall to create a strong layer or skin with reduced permeability, when compared to the untreated borehole wall. The borehole materials can include, for example, mud solids, in the form carried by the drilling mud or settled as a filter cake, which can be formed on porous permeable zones, and drilled solids. The lateral wall stress applied by the pad can be from direct contact with borehole wall or contact of the pad to drill cuttings or mud solids, which are plastered against the borehole wall. This causes the hydraulic film between the pad and the solids of the borehole wall, drill cuttings or mud solids to be reduced such that there is solid to solid contact.

Since the pad is in contact with solids as it is driven against and riding over the borehole wall, the pad preferably includes a means for enhancing its wear so that it can accommodate or resist wear and continue to act throughout the drilling process. The wear resistance need only be applied at the pad surface that has solid contact.

The pad is intended to plaster and compact the borehole wall by application of lateral stress thereagainst. Thus, in a one embodiment, the pad is formed to ride over the surface rather than scraping or digging into it. To facilitate riding over the solids of the borehole wall or those solids disposed between the pad and the borehole wall, pad can be devoid of sharp edges that can dig into the formation, for example, the pad leading edge can be graduated as by radiusing or beveling. It is to be noted, however, that the pad should be selected to apply sufficient localized force, directly or indirectly, against the borehole wall to compact the materials of the borehole wall and/or mechanically work mud solids and drilled solids against the borehole wall to thereby enhance borehole integrity by reducing wall permeability and sloughing. It is believed that, in poorly consolidated sandstones, beneficial effects can be achieved by line load of 10 to 100 pounds/inch.

The pad is driven substantially continuously against the borehole wall while drilling to apply a lateral wall stress load helically about the borehole wall. Preferably, the pad sweeps the complete circumference of the borehole wall during each revolution of the drill bit, as the drill string advances, such that the pad applies stress load in a substantially continuous path to treat, with consideration to the drill bit rates of advancement and rotation and the size of the pad, at least a major portion of the borehole wall in a selected interval of the borehole so that in that interval, there are few zones over which the pad has not passed, which zones are therefore unstabilized or leaky. As discussed below, treatment of a major portion of the borehole wall may also be affected by providing a plurality of pads that together are driven against the borehole wall to increase, overlap and/or provide redundancy in borehole wall stabilization.

The pad is preferably also driven substantially continuously against the borehole wall to reduce damaging impact caused, for example, by the pad lifting off the surface and forcefully landing again, and thereby digging into, hammering or beating the formation. In one embodiment, the pad is mounted to be resilient to follow the contour of the borehole wall and to avoid easily lifting off the borehole wall. This resiliency can be provided through a biasing means such as a spring or hydraulic acting against the pad. Alternately or in addition, the resilient nature of the pad can be provided by means of the resiliency in the drill string itself, on which the pad is carried. As such the pad is disposed, with reference to the borehole radius, to have an effective radius such that the pad would extend outside beyond the radius of the borehole if not constrained within the borehole.

In some embodiments, it may be beneficial to the apparatus or method to provide a plurality of pads, each carried by the drill string and disposed to rotate and move axially with the drill bit. The plurality of pads can act to together to plaster and compact the borehole wall to improve borehole wall integrity. The plurality of pads may also act to balance forces on the drilling string generated at the pads so that they do not counteract rotation of the drill string or cause problematic twisting or deflection in the drill string.

It may be desirable to stabilize the borehole wall as soon as possible after it is drilled. In such an embodiment, the pad should be positioned as close as possible to the bottom end of drill string. It may also be necessary to position further pads along the drill string to continue the effect. Alternately, the drill string may, in some embodiments, require stabilization to avoid damaging contact against the borehole wall to destroy the positive effect of the pad contact.

In view of the foregoing and in accordance with another broad aspect of the present invention, there is provided a borehole stabilizing apparatus for use with a drilling apparatus comprising: a pad installable into a drill string to move axially and rotationally with a drill bit of the drill string, the drill bit being rotatable to drill a borehole including a borehole wall, the pad being drivable substantially continuously against the borehole wall to apply a lateral wall stress load helically about the borehole wall during drilling.

The pad can be formed by various means carried on the drill string. The pad can be any apparatus that can be used to provide a smooth resilient contact stress that sweeps substantially the complete circumference of the borehole wall each revolution of the drill bit, or in the case of rotary drilling, each revolution of the drill string. The pad can be mounted onto the drill string tubulars or mounted on a sub to be installed, as by threading into the drill string. In one embodiment, the pad is installed on a bend in the drill string, the bend urging the pad outwardly to ride against the borehole wall. The drill string itself acts in an elastic manner about the bend.

In another embodiment, the pad can be incorporated to a drill string sub connectable between straight joints of pipe or drill collars. The pad can be formed on one side of the sub, such that when the element is installed in the drill string, the pad surface extends a radial distance from the drill string centerline that is greater than the radius of the hole. A plurality of these subs positioned at the junction between several joints of pipe would use the stiffness of the pipe to drive the pads with resiliency against the borehole wall. Of course, the subs must be oriented such that their pads do not line up axially along the drill string.

An alternate embodiment includes a sub including a plurality of smooth blades, each forming a pad, biased outwardly by resilient members such as springs, elastic inserts, or hydraulics. In one embodiment, the sub includes three pad-carrying blades supported by springs so that they each have an effective radius greater than the borehole radius, when the sub is not constrained by the borehole. The lateral wall stress load applied by the blades to the borehole wall can be easily controlled in this embodiment, as can the pad surface contour to prevent digging into the borehole wall. The blades and sub must be durable to withstand operation wherein they are moved rotationally and axially with the drill bit, such as by installing in the drill string in a rotary drilling operation. The blades are biased to ride over the borehole wall and to follow the surface contour thereof.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE INVENTION

Figure 1A:
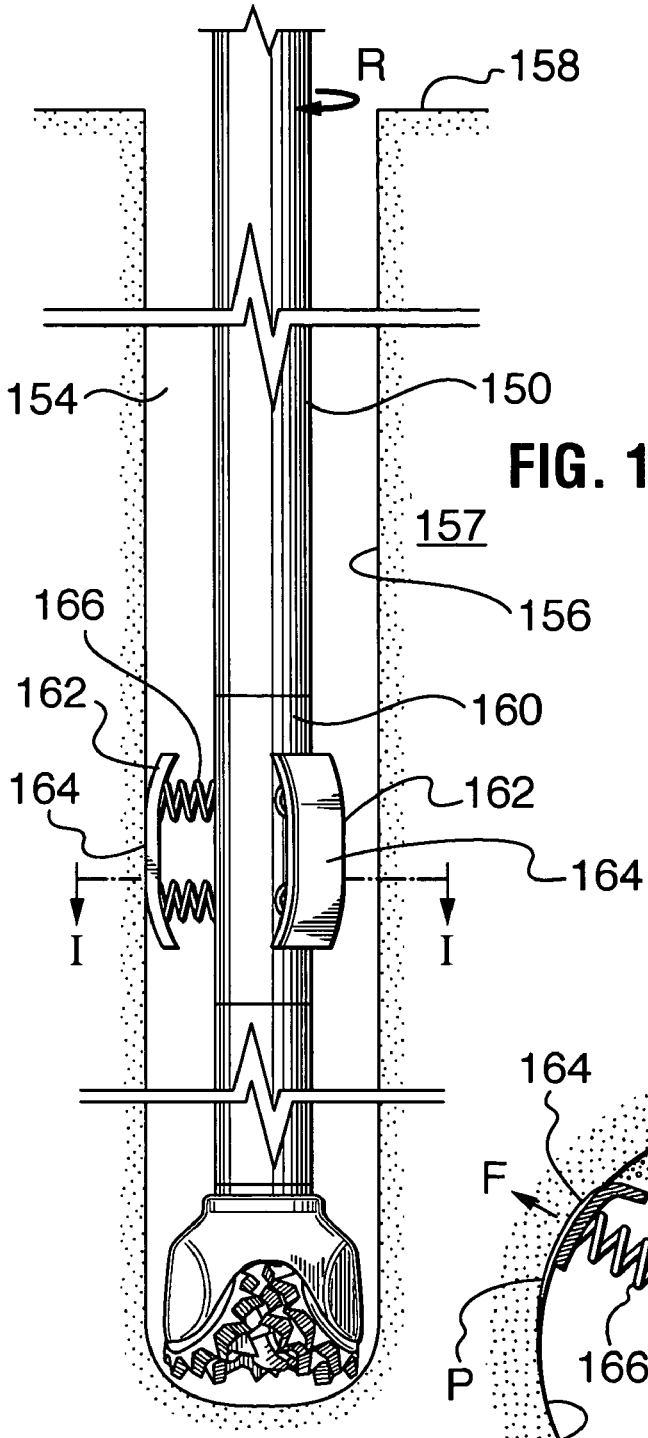
FIG. 1A is a schematic sectional view along a wellbore illustrating a method according to the present invention.

A method and apparatus for conditioning the borehole wall of wells drilled through earth materials has been invented. The method can improve borehole integrity, which is useful when drilling through formations of earth material susceptible of sloughing, such as unconsolidated sandstone. The method can also reduce the risk of lost circulation when drilling through formations difficult to seal using conventional practices primarily relying on the action of filter cake, deposited by invasion of drilling fluids.

In one embodiment, the method includes: providing a drill string and a drill bit connected at a distal end thereof; rotating the drill string while simultaneously moving the drill string axially into or out of the borehole of a well containing drilling fluid as required to drill the well or maintain the borehole over at least one selected well interval, the borehole including a borehole wall; providing the drill string with one or more contoured pads having outward facing generally convex surfaces and means to laterally force the contoured pads into continuous contact with the borehole wall to create one or more rotating local contact stress zones having a length and circumferential distribution of contact stress determined by the shape of the contoured pad and applied lateral force; the magnitude and distribution of local contact stress selected according to properties of the earth materials occurring in the at least one selected well interval to promote borehole wall stability and sealing against loss circulation but avoid excess stress causing spalling or other failure of the earth material; the combination of rotation and axial movement of the drill string causing each local contact stress zone to move on a generally helical sweep pattern having a local pitch; the axial length of local contact stress zone, as determined by the contact length of the contoured load pad or pads, in combination with the position and number of pads is selected to ensure the entire borehole wall surface is swept, at least once, even where the local pitch is a maximum; and the leading edge, with respect to the direction of rotation, of the contoured load pad outward facing surface is preferably shaped to provide a converging drilling fluid filled channel with the borehole wall in front of the zone of contact so as to encourage trapping and compaction of solids entrained in the drilling fluid and discourage scraping of the borehole surface; together seeking to ensure that the entire surface of the borehole wall over the selected well interval is at least once subjected to application of a local contact stress riser, preferably applied in combination with compacted solids particles otherwise carried in the drilling fluid to thus simultaneously plaster the borehole hole wall with a solids pack and compact this material with that of the near well bore earth material tending to form a generally compressive skin of reduced permeability.

To obtain the most immediate benefit from the present invention during drilling, it will be apparent that it is preferable to provide contact pads near the bit as this will minimize the time between drilling and application of the rotating contact stress to the borehole wall, thereby simultaneously minimizing the time for rock failure or 'washouts' to develop and the interval length exposed to greater risk of lost circulation. The contoured pads may be provided in various shapes, however since the borehole is generally cylindrical, the outward facing generally convex pad surfaces are most readily provided also as generally cylindrically shaped, with a radius of curvature somewhat less than-that of the borehole wall to be contacted. This shape also readily provides a converging channel at the leading edge of the pad when in contact with the borehole wall. The length of pad is selected in combination with the applied force and local curvature to ensure continuous contact occurs between the pad and borehole wall during conditions of rotation, as required by the method of the present invention, and is not prevented by hydrodynamic forces tending to push the rotating pad away from the borehole wall creating a film of sufficient thickness to prevent compaction of the solids entrained in the drilling fluid.

The method of the present invention is thus seen to differ from the teachings of the prior art with respect to contact stress between drill string components and the wellbore wall arising from lateral forces in two principle respects. First, the majority of drill string components are designed to minimize wear associated with just such a reduction in hydrodynamic film to the point where continuous and therefore abrasive contact occurs. Second, even where contact is allowed for, such as at stabilizers, the contact is not intended to sweep the entire well surface but is directed toward centering the drill string, preventing lateral impact loading causing failure of the borehole wall material and continuous circumferentially statically positioned contact causing keyseating.

Instead, the method of the present invention employs application of a controlled rotating contact stress field to the entire surfaces of certain borehole rocks, in the presence of typical solids carrying drilling fluids, tends to mechanically work the near borehole wall material to improve both its strength and ability to seal between the typically higher pressure of the wellbore fluid relative to the formation fluid. While the required stress level to achieve optimum results will vary depending on rock properties, beneficial results have been obtained in unconsolidated sandstones, for cylindrical pad contact line loads in the range of 10 to 100 lb/inch. As already taught the lower bound load to achieve at least some beneficial solids compaction is limited by the load required to develop hydrodynamic film separation. The maximum load is limited by risk of spalling or fatigue failure of the formation rock as well as practical limitations imposed by available torque as it will be evident that the contact force occurring at each pad produces an associated drag force adding to the torque required to rotate the drill string.

While many possible means of applying lateral force exist in principle, in the drilling environment two broad sources of force are more readily available and therefore preferred: radial deflection of resilient elastic members and hydraulic pressure typically existing across the drill string tubular wall. Hydraulic pressure may be exploited by providing hydraulic actuators acting between the contoured pads and the drill string. Radial deflection of resilient elastic members required to develop a lateral force is readily provided by interference between the drill string components carrying the contoured pads and the borehole wall. The resilient elastic members may be provided as separate components, for example bow springs carrying the contoured pads, or the drill string pipe may itself be pressed into service where the tubular members loaded in opposition at spaced axial position act as long resilient beams.

Figure 1B:
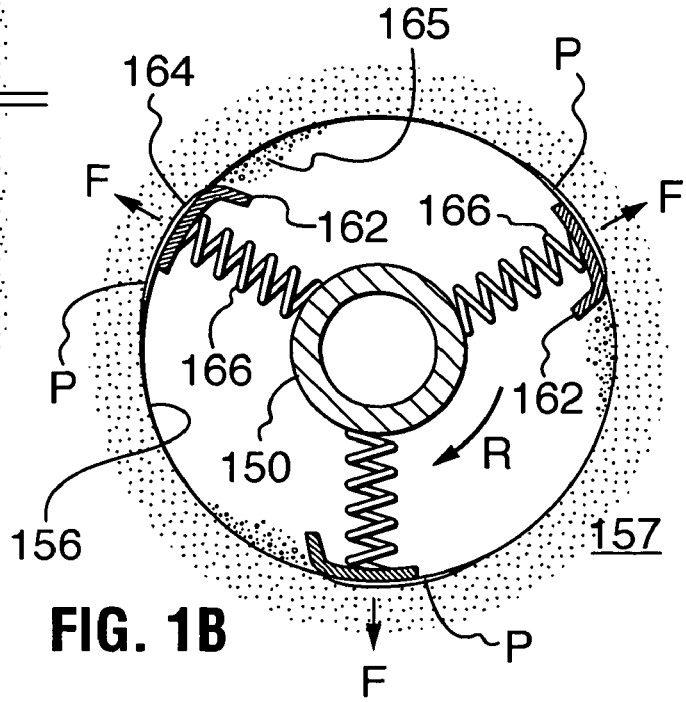
FIG. 1B is a sectional view along lines I—I.
Figure 2A:
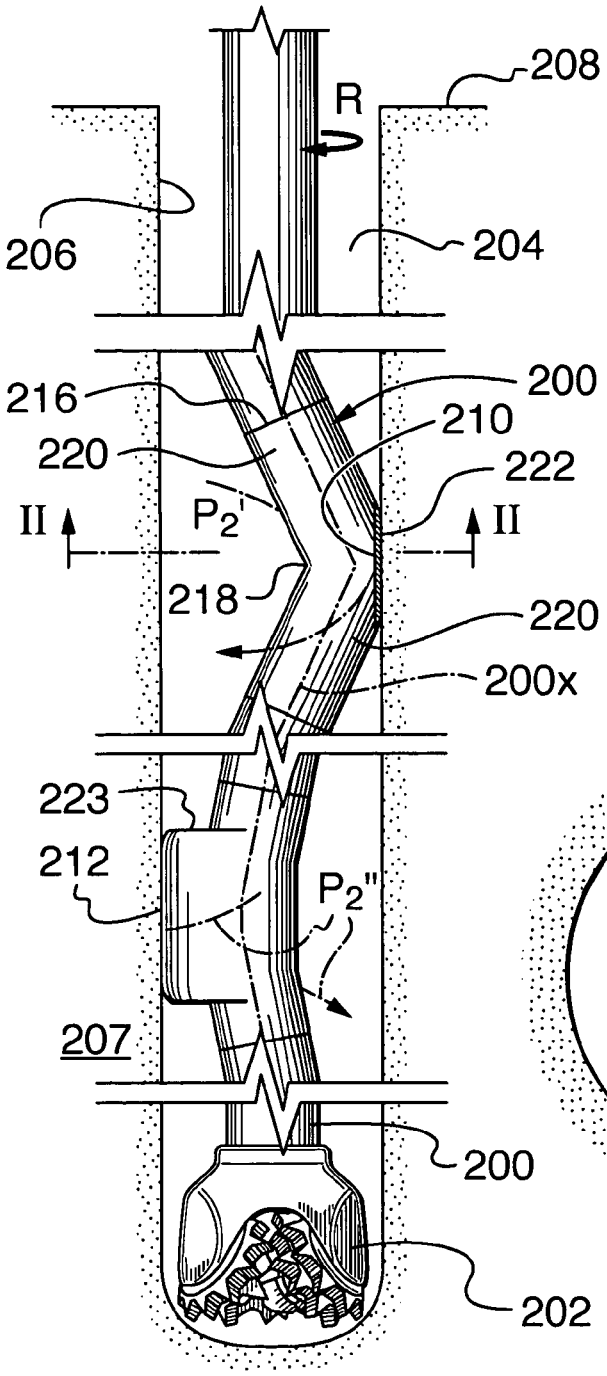
FIG. 2A is a schematic sectional view along a wellbore illustrating a method according to the present invention.
Figure 2B:
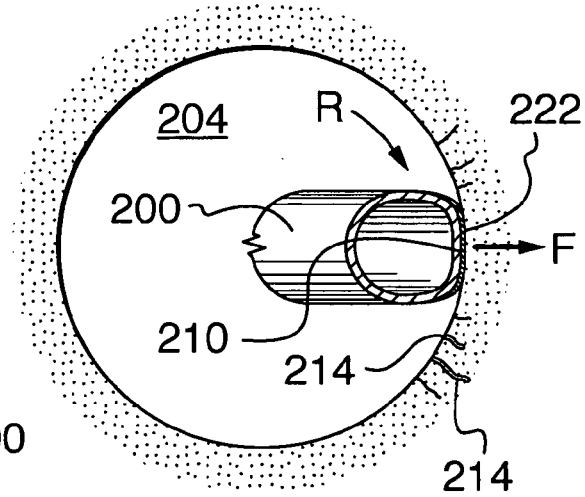
FIG. 2B is a sectional view along path P2 of FIG. 2A, as shown by section lines II—II.
Figure 3A:
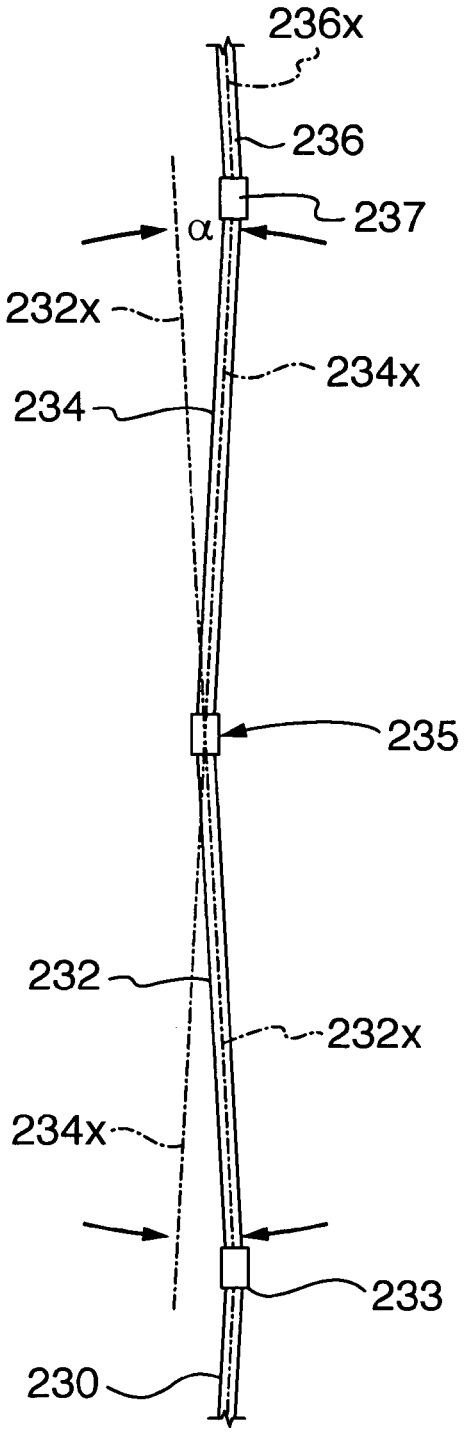
FIG. 3A is a front elevation of a drill string useful in the present invention, using casing as the drill string.
Figure 3B:
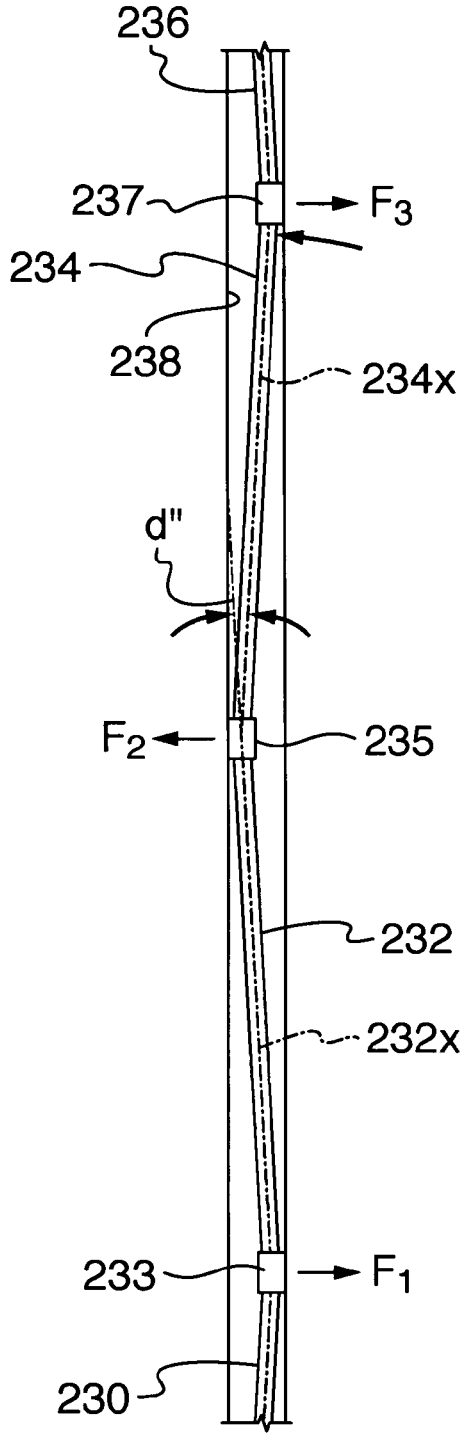
FIG. 3B is a schematic sectional view along a wellbore illustrating another method according to the present invention, using the drill string of FIG. 3A.

FIGS. 1A and 1B are schematic views illustrating an apparatus and method according to the present invention. FIGS. 2A and 2B are schematic views illustrating another method and apparatus according to the present invention, wherein the pads are carried at bends in the drill string. FIGS. 3A and 3B are schematic views illustrating another method and apparatus according to the present invention wherein casing is employed as the drill string.

Referring first to FIGS. 1A and 1B, a method and apparatus is shown schematically for drilling a well and stabilizing a borehole wall in an unstable formation 157, for example of unconsolidated sand stone wherein problems of sloughing and fluid loss have been encountered. The apparatus includes a drill string 150 with a drill bit 152 connected at a distal end thereof. The drill bit is rotatably driven to drill a borehole 154 by rotation of the drill string. The borehole being drilled includes a borehole wall 156, which are the exposed earth materials from the formation. The borehole can extend from surface 158, as shown, or can be a lateral well extending from another borehole. The borehole can be vertically or horizontally oriented, straight or deviated, etc.

Drill string 150 carries a sub 160 including three smooth blades 162, each forming a pad surface 164, biased outwardly by resilient members 166 such as springs or elastic inserts. The blades, at their pad surface 164, define an effective radius greater than the borehole radius, when the sub is not constrained by the borehole. However, when the drill string is confined in borehole 154, having a radius according to the drill bit being used, the blades will be constrained by and apply a lateral wall stress, arrow F, against the borehole wall as they are biased outwardly. When the string including sub 160 is rotated, arrow R, within the confinements of a borehole, the pads 164 cause an axisymmetric to helical plastering action against the borehole wall. The plastering action, thus provided, results in axisymmetric to helical paths P of consolidation in the well bore earth material exposed on and adjacent to the borehole wall, as the pads are driven thereover. The blades also mechanically work, as by crushing, applying and compacting, solids 165 such as mud solids or drilled solids, into the porosity and fractures of the borehole wall to create a strong layer or skin with decreased permeability and increased surface strength, when compared to the borehole wall over which the blades have not ridden. The blades are biased to ride over the borehole wall and to follow the surface contour thereof.

The lateral wall stress load applied by the blades to the borehole wall can be easily controlled, as by selection of spring force, as can the pad surface contour to prevent digging into the borehole wall. For example, the blade leading edges can each be ramped, as shown. The blades and sub must be durable to withstand operation wherein they are moved rotationally and axially with drill string 150 in a rotary drilling operation. In addition, the length of the pad surfaces of the blades can be selected, with consideration as to the rate of drill string advancement and rate of rotation, so that substantially all or at least a major portion of the borehole wall over a selected interval of the well is plastered as the sub passes thereby.

Drill string 150 can be formed of tubing, for example of a continuous length or formed of interconnected joints. Bit 152 can be selected based on various parameters and can include, for example, a cone-type bit. The drill string can be rotated by employing various means such as by use of a kelly, a top drive or other means. As will be appreciated, selection of the particular means for rotating the drill string is often dependent on the form of drill string being used.

The illustrated sub 160 not only operates to plaster and consolidate the borehole wall, but also acts to centralize the drill string to prevent it from hammering against and thereby damaging the formation and the skin formed by the plastering effect. Note also, that the annulus about the drill string is not considerably obstructed to adversely effect mud flow.

Referring to FIGS. 2A and 2B, another method and apparatus for drilling a well and stabilizing a borehole wall in an unconsolidated formation 207 are shown. The method includes providing a drill string 200 with a drill bit 202 connected at a distal end thereof, rotating the drill string to drive the drill bit to drill a borehole 204. The borehole being drilled includes a borehole wall 206, which are the exposed earth materials from the formation. The borehole can extend from surface 208, as shown, or can be a lateral well extending from another borehole. The borehole can be vertically or horizontally oriented, straight or deviated, etc. The method further includes driving pads 210, 212 along the drill string against the borehole wall while rotating, arrow R, the drill string to apply a lateral wall contact load, arrow F, in an axisymmetrical to helical path about the borehole wall. In the illustrated embodiment, drill string 200 bears at two pads 210, 212 against the borehole wall to define two paths P2', P2" in which a lateral wall contact load is applied against the borehole wall. The applied load consolidates and plasters the surface of the borehole wall.

The pads are formed at bends in the drill string. Each bend is a deviation in the long axis of the drill string and causes the drill string to operate in an elastic sense tending to bias the pads against the borehole wall. This bend can be achieved by forming the drill string tubing, as by bending, milling, etc. Alternately, the bend can be formed through a connection between lengths of tubing. For the purpose of this invention, a connection should be understood broadly to mean any arrangement or device that joins the ends of drill string tubulars to create a section over which a structural union is arranged so that the axes of the joined tubulars is substantially continuous across the connection interval but includes a bend inherent or deliberately introduced at the connection such that the axis although continuous changes direction. Understood thus, the term "connection" includes, but is not limited to, welded connections, integral connections and threaded and coupled connections. For example the connection can be a welded joint between adjacent lengths of tubing, which are brought together to create the bend. As another example, the bend can be located at a threaded connection along the drill string. Such threaded connections are, for example, known as tool joints in drill pipe strings and as couplings in casing strings. The bend can be intentionally generated or inherent in the form of the connection. The vast majority of well bores are drilled with metal tubing strings comprising for example drill pipe, drill collars, casing joints, having threaded connections. Therefore to be most readily implemented, the bends of the drill string can be provided at the threaded connections of the drill string. While some casing strings may have inherent bends at the threaded connections between joints of casing, it may be desirable to intentionally increase or control the angular deviation at selected connections or intentionally introduce angular deviations at further connections. Drill strings of drill pipe and drill collars are generally, due to the tolerances of the drill pipe threaded joints, more straight. Thus, to be useful in the present invention, it may be necessary to modify the drill pipe or drill collar connections to introduce bends into the string. Connections are best provided in a manner that accommodates existing threadforms, sealing geometries and operational tolerances.

The bend can be gradual or abrupt. For example, the bend can be in the form of a gradual axial deviation (i.e. a curve), a sharp axial deviation or a stepped deviation formed by spaced apart deviations in the long axis of the drill string wherein an intermediate section is formed at the bend.

Since the drill string may experience considerable abrasive forces at the bend, it may be advantageous to provide wear protection at the bend. In one embodiment, wear protection is applied to the drill string bend at the circumferential location corresponding to the outside of the bend, since contact with the borehole wall will occur only on the outside of the bend.

Excess wear can be avoided by use of various forms of wear protection such as for example the introduction of wear resistant material to the bend. The wear resistant material may be integral to the material of the bend, obtained by surface hardness treatment such as boronizing, nitriding or case hardening, or applied thereto such as by use of a coating such as hardfacing. The wear resistant material can be introduced at the bend in various ways. For example, the tubulars of the string can have the wear resistant material directly on them. Alternately or in addition, a separate device can be used such as, for example, a wear band, as disclosed in Cdn. Patent App 2,353,249, filed Jul. 18, 2002.

The disclosed wear band includes a band of wear resistant material and is structurally attached to the tubing string by, for example, crimping. This solution is effective and provides a readily implemented means to enhance the wear resistance of the tubing string at the bend. As another example, a wear resistant coupling or sub can be used. For application of the present invention to a casing string, the bend can be formed at a casing coupling and the wear resistance can be applied or formed integral thereto, as disclosed in applicant's corresponding International application WO/03/008755, published Jan. 30, 2003. Thus, a useful casing connection includes a wear resistant material on at least a portion of its outer surface. The wear resistant material can be arranged to at least overlap the circumferentially oriented location forming the outside of the bend at which the coupling is positioned.

When a string including a bend therein is rotated within the confinements of a borehole, the bend rotates with the drill string and the drill string rotates with respect to the borehole. When driven against the borehole wall, the bend causes an axisymmetric to helical 'wiping' action on the interior of the borehole wall, the wiping action thus provided, results in an axisymmetric to helical path of consolidation in the well bore earth material exposed on and adjacent to the borehole wall, as the bend is driven thereover. This consolidation increases the stability of the borehole wall earth material by packing the earth materials and closing fissures and pores therein, thereby reducing risk of sloughing and of lost circulation.

The degree of consolidation and associated benefits depends on the lateral force generated by the drill string as it bears against the borehole wall. The lateral force generated by the bend bearing against the borehole wall can be controlled by selection of the bend angle magnitude and/or bend direction. The lateral forces generated at a bend will tend to increase with increasing bend angle. The control of bend direction, especially with consideration to the drill string configuration and positioning within the confines of the borehole, for example as caused by other bends along the drill string, provides control of lateral forces generating when compared to random orientation of connection bend direction. Thus in one embodiment, the method further includes selecting the angle magnitude of at least one bend along the drill string to control the lateral reaction force of the drill string against the borehole wall in which the drill string is intended to extend and in another embodiment, the method further includes selecting the angular direction of at least one bend along the drill string to control the lateral reaction force of the drill string against the borehole wall in which the drill string is intended to extend. Control of the connection bend magnitude, and preferably also the bend direction, enables control of said lateral force exerted and is, thus, a means to balance the benefits gained by wiping action on the borehole wall against other factors such as resistance to drill string advancement and the eccentric wear rate of the string at the bend.

Where a plurality of spaced apart bends are positioned along an interval of the drill string and the drill string is rotated to drill a borehole such that the interval becomes positioned in the borehole, the bend angle and direction of the plurality of bends control the local lateral wall contact load applied by the interval against the borehole wall as it is positioned within the confines of the borehole. The bend angle and direction of at least some of the bends can advantageously therefore be arranged to deflect some or all of the bends into selected contact, for example generally radially opposed contact, with the borehole wall over the interval.

When considering the use of casing connections to control bend angle magnitude and direction, the bend magnitude and direction occurring across a threaded connection is a function, for example, of one or more of the casing joint end straightness, joint thread axis angle alignment with the joint axes and the coupling thread axes. For industry typical casing connections, the bend magnitude or axis misalignment is not tightly controlled, as for example described in the API Specification 5CT and Standard 5B. Furthermore, the bend direction is randomly oriented. Thus to select bend angle or direction, it is necessary to either review and select the particular casing joints and casing connections to be used in the drill string of casing or form the casing string components to be used to form the bends. Thus, in one embodiment, where casing is used as a drill sting, the method further includes providing casing string components for assembling a casing string having controlled bend angle magnitude or direction, for example, including a casing connection formed to provide a controlled bend in the axes of the casing tubulars joined by the casing connection. The controlled bend can be selected such that when said casing connection is employed to assemble the casing tubulars to form at least one interval of a casing drill string placed in a borehole, the resulting bend of a selected bend magnitude and/or direction in the interval such that the bend contacts the borehole wall. Where a plurality of said casing connections are used, the resultant bends can be selected to induce selected bend angle magnitudes or directional variations to induce some or all of the bent wear resistant connections to at least contact the borehole wall and induce selected lateral wall contact forces, such as generally radially opposed contact forces between the plurality of bends.

As a means to more predictably control said radially opposed contact forces, in a further embodiment, said wear resistant casing connection of controlled bend is provided having the circumferential direction of the bend controlled with respect to a casing string assembled from such connections. Such control of circumferential direction is preferably selected to provide a repeating pattern between bent connections comprising an interval of an assembled casing string.

In the illustrated embodiment of FIGS. 2A and 2B, drill string 200 includes at least two bends carrying pads 210, 212. The bends are selected such that, when the drill string is confined in a borehole sized according to the drill bit being used, the bends will be constrained by and bias the pads against the borehole wall. When the string including bends is rotated within the confinements of a borehole, the bends cause the pads to effect a continuous, axisymmetric to helical 'wiping' action on the interior of the borehole wall, the wiping action thus provided, results in an axisymmetric to helical path of consolidation in the well bore earth material exposed on and adjacent to the borehole wall, as the bend is driven thereover. This consolidation increases the stability of the borehole wall earth material by packing the earth materials, closing fissures 214 and pores therein and mechanically working materials from the mud stream, filter cake into the porosity of the borehole wall, thereby reducing risk of sloughing and of lost circulation when compared to a borehole hole wall surface over which the bend has not passed.

Since it is desirable to stabilize the borehole wall as soon as possible after it is drilled, it is preferred therefore, that pads 210, 212 in the drill string be positioned as close as possible to the bottom end of the drill string. It is also desirable that as much as possible of the borehole wall be compacted by application of lateral wall contact load. Therefore, with consideration to the rate of advancement of the drill string, the surface contact area of the pads with the borehole can be adjusted or further contact areas (i.e. pads) can be provided along the drill string.

Drill string 200 can be formed of tubing, for example of a continuous length or formed of interconnected joints. In the illustrated embodiment, drill string 200 is formed of drill pipe connected by threaded pipe connections 216. Bit 202 can be selected based on various parameters and can include, for example, a cone-type bit. The drill string can be rotated by employing various means such as by use of a kelly, a top drive or other means. As will be appreciated, selection of the particular means for rotating the drill string is often dependent on the form of drill string being used.

Although the drill string has a continuous long axis 200*x*, the bends are deviations in the long axis of the drill string. In the illustrated embodiment of FIG. 2, the bends are positioned along the drill string by threading bent drill pipe sections into the string.

Pads 210, 212 and bends can be formed in various ways, as by bending, milling, casting, etc. In the illustrated embodiment, pad 210 is carried on a sub including an insert elbow 218 welded between pipe section ends 220. Pad 210 is formed on elbow 218 as a generally flat region with a degree of radial curvature. Pad 210 has applied thereon a wear resistant surface 222. While the wear resistant surface could have been applied over a greater area, to reduce costs surface 222 is only applied to the drill string bend at the circumferential location corresponding to the outside of the bend, since contact with the borehole wall will occur only on the outside of the bend.

Pad 212 is formed on an eccentric extension 223 radially extending from the drill string. Eccentric extension 223 can be fixed, as shown, hydraulically driven or biased outwardly by some means. While eccentric extension 223 is formed on a bent sub, in another embodiment, the eccentric extension can be incorporated to a drill string sub connectable between straight joints of pipe or drill collars. The pad can be formed on one side of the sub, such that when the element is installed in the drill string, the pad surface extends a radial distance from the drill string centerline that is greater than the radius of the hole. A plurality of these subs positioned at the junction between several joints of pipe would use the stiffness of the pipe to drive the pads with resiliency against the borehole wall, rather than requiring a bend in the drill string. Of course, the subs must be oriented such that their pads do not line up axially along the drill string.

The degree of consolidation and associated benefits depends on the lateral force generated by the drill string as it bears against the borehole wall. The lateral force generated by the bend bearing against the borehole wall can be controlled by selection of the bend angle magnitude and/or bend direction. The lateral forces generated at a bend will tend to increase with increasing bend angle. The control of bend direction, especially with consideration to the drill string configuration and positioning within the confines of the borehole, for example as caused by other bends along the drill string, provides control of lateral forces generated when compared to random orientation of connection bend direction. Thus in one embodiment, the method further includes selecting the angle magnitude of at least one bend along the drill string to control the lateral reaction force of the drill string against the borehole wall in which the drill string is intended to extend and in another embodiment, the method further includes selecting the angular direction of at least one bend along the drill string to control the lateral reaction force of the drill string against the borehole wall in which the drill string is intended to extend. Control of the connection bend magnitude, and preferably also the bend direction, enables control of said lateral force exerted and is, thus, a means to balance the benefits gained by wiping action on the borehole wall against other factors such as resistance to drill string advancement and the eccentric wear rate of the string at the bend.

Where a plurality of spaced apart bends are positioned along an interval of the drill string and the drill string is rotated to drill a borehole such that the interval becomes positioned in the borehole, the bend angle and direction of the plurality of bends control the local lateral wall contact load applied by the interval against the borehole wall as it is positioned within the confines of the borehole. The bend angle and direction of at least some of the bends can advantageously therefore be arranged to deflect some or all of the bends into selected contact, for example generally radially opposed contact, with the borehole wall over the interval.

Referring to FIGS. 3A and 3B, a method and apparatus is shown using a drill string of connected casing joints including joints 230, 232, 234, 236. The joints are joined by threaded connection into casing couplers including couplers 233, 235, 237. The drill string of FIG. 3A is useful for drilling a borehole 238, wherein after the borehole is drilled, the casing string can be left in to line the hole. A bit (not shown) is mounted at the distal end of the casing string to provide drilling action. For drilling with casing the bit is selected to be trippable through the casing inner bore and generally includes a pilot bit and an expandable under reamer.

FIG. 3A shows the drill string outside the borehole and FIG. 3B shows the drill string when it is confined in a borehole drilled by the bit. Bends are formed along the casing string at connections 233, 235, 237. In particular, the overall string axis is defined by the axis 230*x*, 232*x*, 234*x*, 236*x* of the individual joints. These axis intersect at the connections. However, it can be seen that the connections tend to deviate the long axis of the drill string, for example by an angle $\alpha'$.

Due to the angular deviation along the long axis of the casing string, when it is constrained in the borehole to be drilling using the string, the connections 233, 235, 237 will be forced to flex to reduce the angle of deviation. For example angle $\alpha'$ will be reduced to $\alpha''$. This permits the string to extend in the borehole, but will cause the connections to be driven against borehole wall 238 such that a lateral wall contact force F1, F2, F3 is applied to the wall, at each connection. Due to the forces applied, the borehole wall is consolidated and, thereby, stabilized, as the drill string and connections 233, 235, 237 pass therethrough.

It is possible that a standard casing connection will, when used to join casing joints, create a deviation. However, the angle of deviation for example at connection 235 can be selected by inspection or forming, to provide a particular angle of deviation between the joints.

When considering the use of casing connections to control bend angle magnitude and direction, the bend magnitude and direction occurring across a threaded connection is a function, for example, of one or more of the casing joint end straightness, joint thread axis angle alignment with the joint axes and the coupling thread axes. For industry typical casing connections, the bend magnitude or axis misalignment is not tightly controlled, as for example described in the API Specification 5CT and Standard 5B. Furthermore, the bend direction is randomly oriented. Thus to select bend angle or direction, it is necessary to either review and select the particular casing joints and casing connections to be used in the drill string of casing or form the casing string components to be used to form the bends. Thus, in one embodiment, where casing is used as a drill sting, the method further includes providing casing string components for assembling a casing string having controlled bend angle magnitude or direction, for example, including a casing connection formed to provide a controlled bend in the axes of the casing tubulars joined by the casing connection. The controlled bend can be selected such that when said casing connection is employed to assemble the casing tubulars to form at least one interval of a casing drill string placed in a borehole, the resulting bend of a selected bend magnitude and/or direction in the interval such that the bend contacts the borehole wall. Where a plurality of said casing connections are used, the resultant bends can be selected to induce selected bend angle magnitudes or directional variations to induce some or all of the bent wear resistant connections to at least contact the borehole wall and induce selected lateral wall contact forces, such as generally radially opposed contact forces between the plurality of bends.

As a means to more predictably control said radially opposed contact forces, in a further embodiment, said wear resistant casing connection of controlled bend is provided having the circumferential direction of the bend controlled with respect to a casing string assembled from such connections. Such control of circumferential direction is preferably selected to provide a repeating pattern between bent connections comprising an interval of an assembled casing string.

The connection bend angles were calculated from sample of typical 7 inch (178 mm) API buttress threaded and coupled (BTC) casing joints. These magnitudes were used to calculate the possible maximum lateral load arising from this load mechanism, were such casing joints assembled into a casing string and placed in a borehole drilled with a bit size of 8.5 inches (216 mm). It was found that, with negligible axial load, a lateral force of at least 1000 lbf (4450N) could be applied against the borehole wall at each connection if at least an interval of such casing joints were assembled into a casing string and the string was confined in the borehole. As will be appreciated, axial load such as by the weight of the drill string or weight on bit will increase the lateral force at each connection.

In a method wherein casing joints are connected and the bends are formed at their connections, a wear resistant casing connection can be employed to address the problems arising from wear. In its preferred embodiment, the wear resistant casing connection is generally of a threaded and coupled nature and more preferably employs a thread-form geometry compatible with a buttress connection as specified by the American Petroleum Institute (API).

Such existing threaded connections include the thread-forms and sealing geometries comprising so called premium connections, in addition to both integral and threaded and coupled American Petroleum Institute (API) specified geometries. (Reference herein to a 'thread-form' is generally understood to include the seal geometry if present, unless these two components of the connection geometry are specifically separated in the context.) This accommodation of existing geometry extends to the connection diameter where it is preferable to provide wear resistance without a significant increase in outside diameter to avoid correlatively increasing the annular flow resistance, where such a wear resistant connection is deployed in a casing string within a well bore.

It is advantageous to adapt existing threaded connection geometries to provide locations where wear resistant materials can be most economically and least invasively applied to the connection, i.e., without significantly altering the existing connections with respect to seal and structural performance, while providing adequate protection against wear from rotation while drilling. In particular, preferably the wear resistant material is provided at the lower or leading end of the coupling (leading is defined with respect to the axial direction of travel while drilling), as the upset diameter change from the pipe body to the coupling occurring at this location tends to promote preferential wear while drilling with casing.

Threaded and coupled connections useful in the present invention can include an internally threaded coupling having an upper end, a lower end and generally cylindrical exterior surface, as typically provided for such couplings, where wear resistant surface treatment or coating material is disposed axisymmetrically on said external surface over one or more axial intervals to form one or more hardbands of diameter somewhat greater than the diameter of the generally cylindrical exterior surface. Said axial interval length and coating thickness are chosen, based on application requirements, to provide sufficient volume of material to resist wearing through to the base metal. Wear resistant surface treatment or coating material is axisymmetrically distributed to accommodate the random distribution of bend angle and hence circumferential location of connection contact with the well bore.

For most of these geometries, wear resistance can be provided by applying coatings resistant to abrasive wear to the exterior surface of the connection. Such coatings are commonly referred to as hardfacing. These coatings are applied using a variety of techniques and materials, but typically the bond chemistry and mechanics require heat input to obtain the elevated temperature required to create a strong bond between the coating and metal substrate. It is therefore necessary to consider the effects of this heat input and bond chemistry on the metal substrate, and in particular to allow for any changes in structural or mechanical performance the heat input and bond chemistry might have.

In addition, the choice of axial interval location where wear resistant surface treatment or coating is provided is preferably selected to occur at locations where stresses induced by structural and pressure loads are lowest. Such choice of location reduces the risk of connection failure due to crack initiation within the typically brittle coating material.

However such a suitable region of low stress is often not available for many of the threaded and coupled connection geometries employed by industry. A suitable region of low stress at one or both ends of the coupling can be provided by a coupling having its length and interval of internal threading arranged so that the end hardband interval does not overlap with the internal threaded interval of the coupling. Otherwise stated, relative to the 'standard' non-wear resistant coupling geometry a coupling is provided where at least one end and preferably the lower end is modified to provide a generally cylindrical extension which extension or extensions having external and internal surfaces without load bearing threads on which said external surface or surfaces wear resistant surface treatment or coating material such as hardfacing is applied to create a hardband or hardbands of upset diameter. Where only one hardband is required, the lower end is preferred as this end forms the leading edge of the coupling while drilling with casing and protects this region from preferential wear.

Application of these teachings for placement of wear resistant surface treatment or coating material on the couplings of threaded and coupled connections may be extended to integral connections and externally upset integral connections. As commonly understood in the industry, an integral connection is comprised of an externally threaded pin formed on the end of one tubular screwed into a mating internally threaded box formed on the end of a second tubular. Said internally threaded box having an external largely cylindrical surface and proximal end. Particularly where the connection design is arranged to shoulder on said proximal end when made up to the pin, the stress state in this region is less prone to crack initiation and propagation. A wear resistant integral connection can be used that has a hardband of wear resistant surface treatment or coating material disposed on its proximal end. Relative to the 'standard' non-wear resistant geometry of an integral connection box it is more preferable if the proximal end of the box is modified to provide a generally cylindrical extension which extension having external and internal surfaces without load bearing threads on which said external surface wear resistant surface treatment or coating material such as hardfacing is applied axisymmetrically to create a hardband or hardbands of upset diameter.

Where the integral connection is formed on externally upset tubulars, such externally upset interval typically extends beyond the depth required to carry the box or pin threaded connection geometry, and in certain applications it may be preferable to provide a hardband on the connection exterior surface at or near the leading end of the upset interval either separately or in combination with a hardband placed at the proximal end of the box. The leading end of the upset interval, thus carrying the hardband, occurs at a location of significantly greater thickness than the pipe body and therefore of significantly reduced stress, but having the further advantage of being positioned at the location of preferential wear. Therefore, a wear resistance externally upset tubular connection can be provided having an externally upset interval with leading and trailing ends comprising the connection, and having at least one hardband positioned on said leading end.

Figure 4:
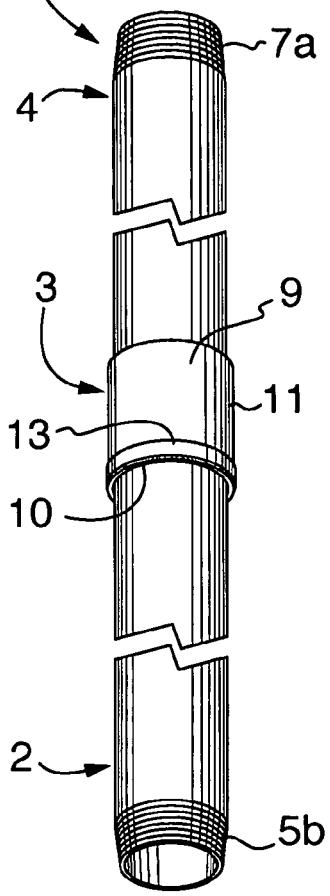
FIG. 4 is a perspective view of a wear resistant casing connection useful in the present invention.
Figure 5:
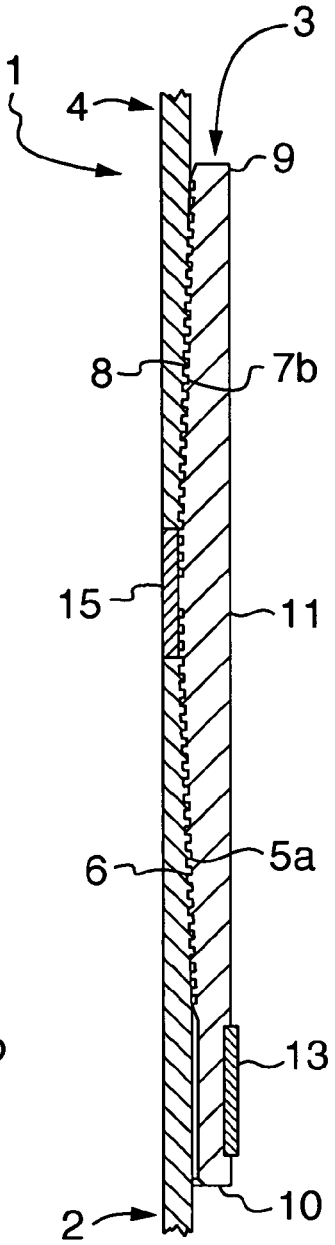
FIG. 5 is a sectional view through the sidewall of the connection shown in FIG. 4 wherein a shoulder ring is included to provide improved torque capacity.

Referring to FIGS. 4 and 5, an assembled threaded and coupled wear resistant connection 1 is shown that is useful in one embodiment of the invention including a lower joint 2 with threaded ends 5*a*, 5*b*, an internally threaded coupling 3 and an upper joint 4 with threaded ends 7*a*, 7*b*. As commonly understood in the industry, the connection is assembled or 'made up' by screwing the externally threaded mill end pin 5*a* of lower joint 2, into the mill end box 6 of coupling 3 and screwing the field end pin 7*b* of upper joint 4 into the field end box 8 of coupling 3 to form a sealing structural union. The generally cylindrical coupling 3 includes an upper end 9, a lower end 10 and a hardband 13 formed from application of hardfacing axisymmetrically about the circumference of the coupling on the exterior surface 11 adjacent lower end 10. In the illustrated embodiment, the hardfacing is applied in a substantially uniform thickness to form the hardband.

The main body of coupling 3 is arranged to generally match the thread-form geometry, tolerancing and length of an API specified buttress connection, where the lower end 10 is formed as a generally cylindrical extension of the main body. The extension extends out beyond the threads 6*a* of the mill box end a sufficient length to carry the hardband 13 such that the hardband does not radially overlap the threaded interval of the mill end box 6.

The outer diameter of the coupling at hardband 13 is preferably selected to be greater than the diameter of the coupling outer surface 11 to such that the hardband preferentially contacts the borehole wall when connection 1 is employed in a casing string. However, when selecting the outer diameter of the hardband, care should be taken, with consideration as to the borehole diameter in which the coupling is to be used to reduce adverse effects on annular flow.

A multi-lobe shoulder ring 15 is disposed in the coupling center region, between the mill and field end pins 5*a*, 7*b*. Under application of sufficient torque the mill and field end pins 5*a*, 7*b* are caused to abut ring 15 to thus increase torque capacity in support of drilling with casing as described in Canadian Patent Application 2,311,156.

The illustrated embodiment of FIGS. 4 and 5, thus shows a wear resistant connection where the manufacturing of the pin and box thread-forms is compatible with existing industry practice with respect to geometry, tolerance and make-up practice. However, it is to be understood that other connections can be used.

Figure 6:
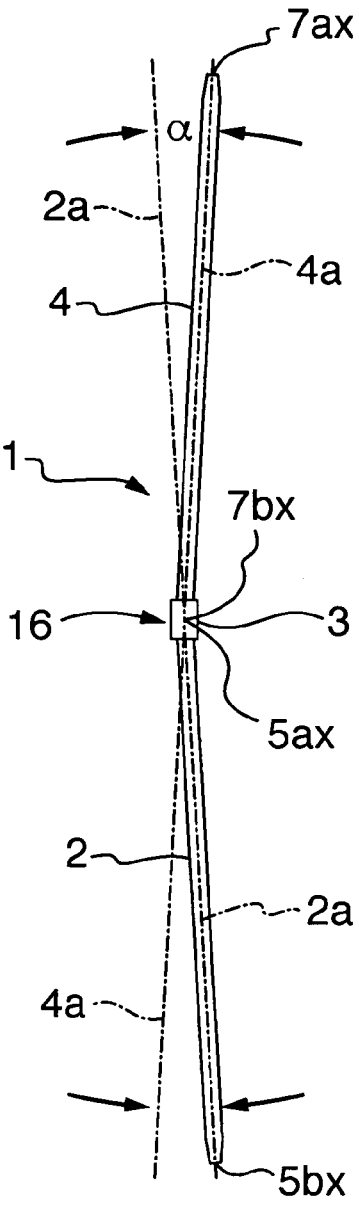
FIG. 6 is a front elevation of a pair of connected casing joints showing a bend angle formed by the connection shown in FIG. 4.

The bend angle and direction formed across the assembled connection 1 depends on the cumulative effect of the thread axis angle misalignments and the relative direction of the misalignments for the pins 5*a*, 7*b* and boxes 6, 8 after make-up. With reference now to FIG. 6, the bend angle $\alpha$ is defined as the angle change between a first line 2*a* extending though the center points 5*ax*, 5*bx* at the ends of the lower joint 2 and a second line extending though the center points 7*ax*, 7*bx* at the ends of the upper joint 4 in the connection. The bend angle or connection straightness is dependant on variables generally controlled by specifications known to the industry such as: pipe straightness, pin geometry parameters such as imperfect thread limits for buttress threads, coupling thread angular misalignment and make-up position. Prevalent industry practice for control of these variables results in randomly controlled casing connection bend magnitudes, where a significant number of connection bend angles are greater than allowed by comparable drill pipe specifications. Therefore, when a plurality of such connections are employed to form a tubular casing string placed in a bore hole, joint to joint local directional variations interfering with the borehole confinement are likely. As noted hereinbefore, this interference is frequently great enough to cause large radial or lateral reaction loads between the connection outside bend surface 16 and the confining borehole wall and, thus, there is a need to protect the connections against excess rates of wear under conditions of extended rotation, such as in drilling with said tubular casing string.

While the wear resistant connections shown in FIGS. 4 and 5 are useful for applications where the bend angle $\alpha$ is allowed to vary randomly in accordance with typical industry practice for manufacture and assembly of threaded and coupled casing connections, in certain applications it is desirable to control the magnitude of said lateral reaction force in at least one interval of an assembled casing string, which lateral reaction force is dependent on several design variables including: casing flexural stiffness, spacing between contacting bent connections, axial load, relative radial orientation of connection bends and radial interference of local bent section as controlled by the magnitude of the connection bend angle $\alpha$.

To control of lateral load arising in an interval of a casing string, it is useful to control the bend angle geometry and spacing along that string interval. This can be done by surveying couplings and casing joints to determine the bend angle magnitude at a connection of selected ones of the couplings and casing joints and selecting the couplings and casing joints to be used in the string interval.

Figure 7:
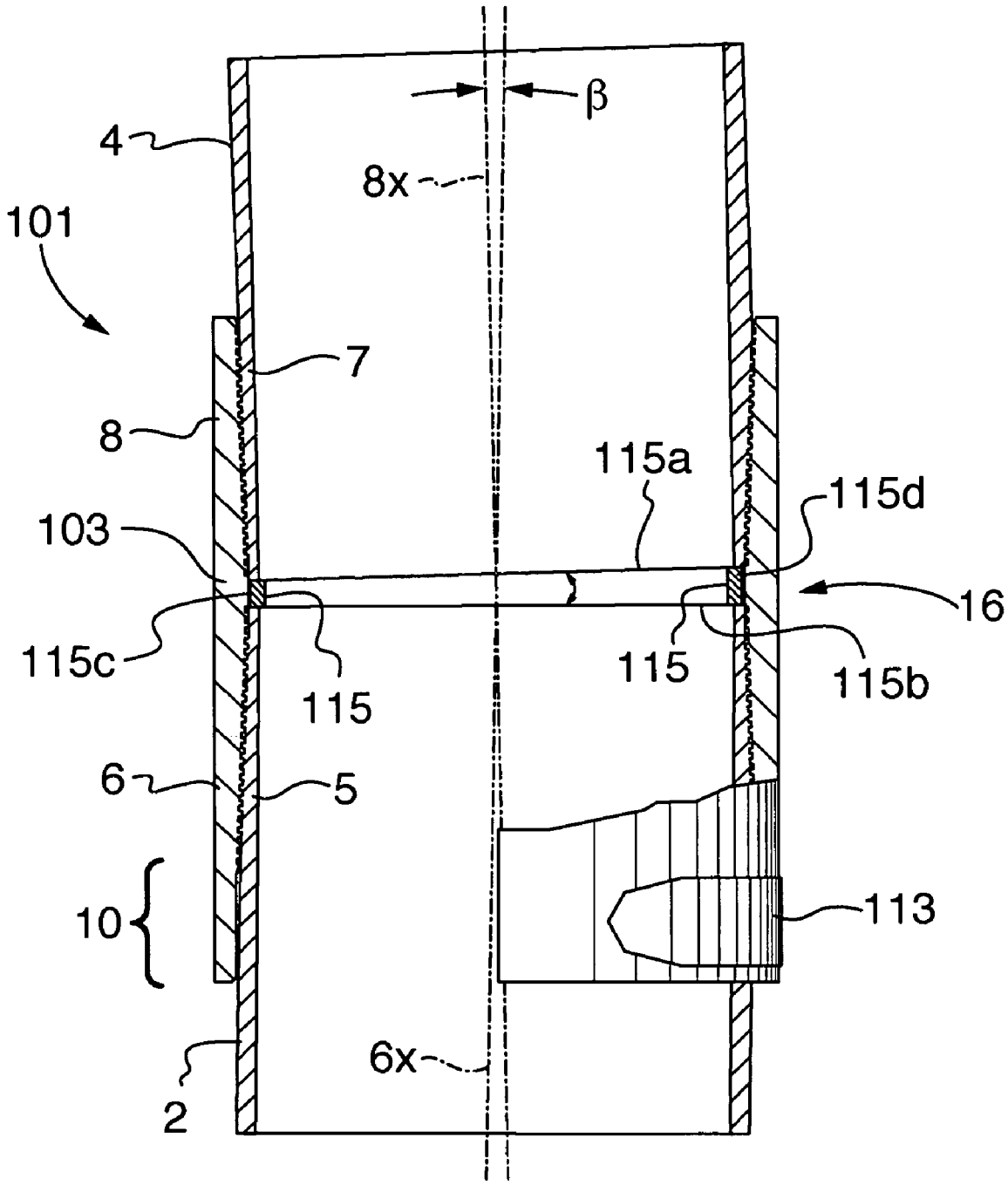
FIG. 7 is a partially cut away view through another connection, where the coupling bend angle is controlled.

Referring now to FIG. 7, in an alternate embodiment of the present invention a bent wear resistant connection 101 can be used where the center axis 6*x* of the mill end box 6 and the center axis 8*x* of the field end box 8 are offset out of alignment to form a bent coupling 103 having an angle β between axes 6*x* and 8*x*. A wear pad 113 is positioned on the outer surface of the coupling about the circumferential location defined by the outside bend 16 of bent coupling 103. Coupling 103 accommodates a shoulder ring 115 which substantially conforms to the bend of the coupling. In particular, shoulder ring 115 includes end faces 115*a*, 115*b* defining planes that are not parallel, such that the width of the ring varies from a narrow wall 115*c* to a long wall 115*d*. The ring is set within the coupling bore having its long wall 115*d* positioned radially inwardly of outside bend 16 of the bent coupling 103. The planes of end faces 115*a*, 115*b* there between define an angle selected to be similar to that of angle β.

In use, the bent coupling can be employed to achieve further control of said lateral force arising from confinement within a borehole, by selecting the frequency of bent connections and, thereby the spacing there between, and by controlling the relative orientation of outside bend position 16 between sequential bent couplings employed to connect a plurality of tubular joints forming an interval in a casing string. To conveniently select the bend orientation of the connection during make up of a string, means, such as a power tong, can be used to apply torque to the coupling for control of mill end make-up position. Final mill end make-up position may then be selected to align the outside bend position of sequential connections at, for example, positions 180° apart or other similar pattern as required.

In a further embodiment, the casing joint pin ends used can have the misalignment tolerance of their thread axes reduced from typical industry practice to further improve control of their bend angle.

It will be apparent that many other changes may be made to the illustrative embodiments, while falling within the scope of the invention and it is intended that all such changes be covered by the claims appended hereto.

What is claimed is:

1. A method for stabilizing a borehole while drilling comprising: providing a drill string including a drill bit connected at a distal end thereof and a pad carried by the drill string to move axially and rotationally with the drill bit; rotating the drill bit to drill a borehole, the borehole including a borehole wall; and driving the pad in a helical path substantially continuously against the borehole wall while rotating the drill bit to apply a lateral wall stress load helically about the borehole wall.

2. The method of claim 1, wherein the drill bit is driven by rotation of the drill string the pad is carried by the drill string to move rotationally and axially therewith.

3. The method of claim 1, wherein the pad applies lateral wall stress load to the borehole wall as it is driven against the borehole wall to compact earthen materials exposed on the borehole wall.

4. The method of claim 1, wherein the pad applies lateral wall stress load to the borehole wall as it is driven against the borehole wall to plaster borehole solids against the borehole wall.

5. The method of claim 1, wherein the pad applies lateral wall stress load to the borehole wall as it is driven against the borehole wall to reduce the hydraulic film between the pad and the borehole wall such that there is solid to solid contact.

6. The method of claim 1, wherein the pad applies lateral wall stress load to the borehole wall as it is driven against the borehole wall to reduce the hydraulic film between the pad and borehole solids such that there is solid to solid contact and the borehole solids are driven against the borehole wall.

7. The method of claim 1, further comprising selecting the pad to have wear resistance properties.

8. The method of claim 1, further comprising selecting the pad to ride against, substantially without digging into, the borehole wall.

9. The method of claim 1, further comprising driving the pad to sweep the complete circumference of the borehole wall during each revolution of the drill bit.

10. The method of claim 1, wherein the drill bit is driven by rotation of the drill string and the method further comprises driving the pad to sweep the complete circumference of the borehole wall during each revolution of the drill string.

11. The method of claim 1 further comprising stabilizing the drill string to reduce contact of the drill string with the borehole wall except at the pad.

12. A borehole drilling apparatus comprising: a drill string; a drill bit connected at a distal end of the drill string; and at least three pads carried by the drill string to move axially and rotationally substantially continuously with the drill bit, the drill bit being rotatable to drill a borehole, the borehole including a borehole wall and the at least three pads being drivable substantially continuously against the borehole wall to apply a lateral wall stress load helically about the borehole wall as it is moved with the drill bit to stabilize the borehole wall.

13. The borehole drilling apparatus of claim 12 wherein the drill string includes a continuous length of tubing.

14. The borehole drilling apparatus of claim 12 wherein the drill string includes interconnected joints of tubing.

15. The borehole drilling apparatus of claim 12 wherein the drill string includes a string of casing joints connected together for both drilling the borehole and thereafter, remaining down hole to line the borehole.

16. The borehole drilling apparatus of claim 12 wherein the drill bit is driven by rotation of the drill string and the at least three pads are carried by the drill string to move rotationally and axially therewith.

17. The borehole drilling apparatus of claim 12 wherein the at least three pads apply lateral wall stress load to tho borehole wall as they are driven against the borehole wall and the stress load causes compaction of the earthen materials exposed on the borehole wall and plasters materials against the borehole wall.

18. The borehole drilling apparatus of claim 12 wherein at least one pad of the at least three pads includes a means for resisting wear from solid contact.

19. The borehole drilling apparatus of claim 18 wherein the means for resisting wear is applied at the surface of the pad that has solid contact.

20. The borehole drilling apparatus of claim 12 wherein at least one pad of the at least three pads includes a leading edge and the leading edge is graduated to ride over the borehole wall.

21. The borehole drilling apparatus of claim 12 further comprising a means for biasing at least one pad of the at least three pads outwardly such that the at least one pad includes an effective radius from a center axis of the drill string that extends outside the radius of the borehole if not constrained within the borehole.

22. The borehole drilling apparatus of claim 12 wherein the at least three pads are positioned adjacent the bottom end of the drill string.

23. The borehole drilling apparatus of claim 12 further comprising a stabilizing means on the drill string to reduce contact of the drill string with the borehole wall except at the at least three pads.

24. A method for stabilizing a borehole wall in an unconsolidated formation, the method comprising: providing a drill string; rotating the drill string to drive a drill bit to drill a borehole having a borehole wall with exposed wall earth materials in an unconsolidated formation; and driving the drill string against the borehole wall while rotating the drill string such that a lateral wall contact load is applied by the drill string at at least three contact points selected to bear against, substantially without digging into, the borehole wall to consolidate the exposed wall earth materials to increase stability of the borehole wall.

25. The method of claim 24 wherein the drill string is formed of drill pipe.

26. The method of claim 24 wherein the drill string is formed of casing joints connected by casing connections.

27. The method of claim 24 wherein at least a selected one of the at least three contact points is formed by provision of a bend in the drill string.

28. The method of claim 24 wherein the at least three contact points are formed by provision of a plurality of bends along an interval of the drill string.

29. The method of claim 28 wherein the bends are intentionally imposed in the drill string.

30. The method of claim 27 further comprising providing wear protection at the bend.

31. The method of claim 27 further comprising selecting the angle magnitude of the bend.

32. The method of claim 27 further comprising selecting the angular direction of the bend.

33. The method of claim 27 wherein the bend defines an outer bend area on the drill string and the method further comprising providing wear protection at the outer bend area.

34. A method for stabilizing a borehole wall in an unconsolidated formation, the method comprising: providing a drill string; rotating the drill string to drive a drill bit to drill a borehole having the borehole wall; driving the drill string against the borehole wall while rotating the drill string to plaster the surface of the borehole wall substantially continuously along a helical path when drilling through the unconsolidated formation.

35. The method of claim 34 wherein the drill string is formed of drill pipe.

36. The method of claim 34 wherein the drill string is formed of casing joints connected by casing connections.

37. The method of claim 34 wherein the drill string is driven against the borehole wall by provision of a bend in the drill string.

38. The method of claim 34 wherein the drill string is driven against the borehole wall by provision of a plurality of bends along an interval of the drill string.

39. The method of claim 38 wherein the bends are intentionally imposed in the drill string.

40. The method of claim 37 further comprising selecting the angle magnitude of the bend.

41. The method of claim 37 further comprising the angular direction of the bend.

42. The method of claim 37 wherein the bend defines an outer bend area on the drill string and the method further comprising providing wear protection at the outer bend area.

43. The method of claim 34 further comprising selecting the drill string to have a first bend angle and a second bend angle in an interval.

44. The method of claim 43 wherein the directional orientation of the first bend angle is selected.

45. The method of claim 43 wherein the first bend angle is generated at a connection between an upper casing joint and a lower casing joint.

46. The method of claim 45 wherein the connection includes a threaded coupling having a mill end box having a center axis and a field end box having a center axis and the mill end box center axis being angularly offset from the field end box center axis to form a coupling bond angle and the bend angle is controlled by selecting the coupling bend angle.

47. The method of claim 43 wherein the first bend angle is formed by incorporating into the interval a casing joint having a characteristic capable of generating a bend angle in a casing string.

48. The method of claim 43 wherein the first bend angle is formed by incorporating into the interval a casing coupling having a characteristic capable of generating a bend angle in a casing string.

49. A borehole stabilizing apparatus for use with a drilling apparatus comprising: at least three pads installable into a drill string to move axially and rotationally substantially continuously with a drill bit of the drill string, the drill bit being rotatable to drill a borehole including a borehole wall, the at least three pads being drivable substantially continuously against the borehole wall to apply a lateral wall stress load helically about the borehole wall during drilling.

50. The borehole stabilizing apparatus of claim 49 wherein the at least three pads are formed to provide a smooth resilient contact stress that sweeps substantially the complete circumference of the borehole wall each revolution of the drill bit, or in the case of rotary drilling, each revolution of the drill string.

51. The borehole stabilizing apparatus of claim 50 wherein at least a selected one of the at least three pads is biased outwardly from the drill string.

52. The borehole stabilizing apparatus of claim 50 wherein drill string resiliency causes the at least three pads to be biased outwardly against the borehole wall.

53. A borehole drilling apparatus comprising: a drill string including a string of casing joints connected together for both drilling the borehole and, thereafter, remaining down hole to line the borehole; a drill bit connected at a distal end of the drill string; and a pad carried by the drill string to move axially and rotationally with the drill bit, the drill bit being rotatable to drill a borehole, the borehole including a borehole wall and the pad being drivable substantially continuously against the borehole wall to apply a lateral wall stress load helically about the borehole wall as it is moved with the drill bit to stabilize the borehole wall.

54. The borehole drilling apparatus of claim 53 wherein the drill bit is driven by rotation of the drill string and the pad is carried by the drill string to move rotationally and axially therewith.

55. The borehole drilling apparatus of claim 53 wherein the pad lateral wall stress load to the borehole wall as it is driven against the borehole wall and the stress load causes compaction of the earthen materials exposed on the borehole wall and plasters materials against the borehole wall.

56. The borehole drilling apparatus of claim 53 wherein the pad includes a means for resisting wear from solid contact.

57. The borehole drilling apparatus of claim 56 wherein the means for resisting wear is applied at the surface of the pad that has solid contact.

58. The borehole drilling apparatus of claim 53 wherein the pad includes a leading edge and the leading edge is graduated to ride over the borehole wall.

59. The borehole drilling apparatus of claim 53 further comprising a means for biasing the pad outwardly such that the pad includes an effective radius from a center axis of the drill string that extends outside the radius of the borehole if not constrained within the borehole.

60. The borehole drilling apparatus of claim 53 wherein the pad is positioned adjacent the bottom end of the drill string.

61. The borehole drilling apparatus of claim 53 further comprising a stabilizing means on the drill string to reduce contact of the drill string with the borehole wall except at the pad.

62. A borehole drilling apparatus comprising: a drill string; a drill bit connected at a distal end of the drill string; a pad carried by the drill string to move axially and rotationally with the drill bit, the drill bit being rotatable to drill a borehole, the borehole including a borehole wall and the pad being drivable substantially continuously against the borehole wall to apply a lateral wall stress load helically about the borehole wall as it is moved with the drill bit to stabilize the borehole wall; and a means for biasing the pad outwardly such that the pad includes an effective radius from a center axis of the drill string that extends outside the radius of the borehole if not constrained within the borehole.

63. The borehole drilling apparatus of claim 62 wherein the drill string includes a continuous length of tubing.

64. The borehole drilling apparatus of claim 62 wherein the drill string includes interconnected joints of tubing.

65. The borehole drilling apparatus of claim 62 wherein the drill string includes a string of casing joints connected together for both drilling the borehole and thereafter, remaining down hole to line the borehole.

66. The borehole drilling apparatus of claim 62 wherein the drill bit is driven by rotation of the drill string and the pad is carried by the drill string to move rotationally and axially therewith.

67. The borehole drilling apparatus of claim 62 wherein the pad applies lateral wall stress load to the borehole wall as it is driven against the borehole wall and the stress load causes compaction of the earthen materials exposed on the borehole wall and plasters materials against the borehole wall.

68. The borehole drilling apparatus of claim 62 wherein the pad includes a means for resisting wear from solid contact.

69. The borehole drilling apparatus of claim 68 wherein the means for resisting wear is applied at the surface of the pad that has solid contact.

70. The borehole drilling apparatus of claim 62 wherein the pad includes a leading edge and the leading edge is graduated to ride over the borehole wall.

71. The borehole drilling apparatus of claim 62 further comprising a second pad carried by the drill string to move axially and rotationally with the drill bit.

72. The borehole drilling apparatus of claim 62 wherein the pad is positioned adjacent the bottom end of the drill string.

73. The borehole drilling apparatus of claim 62 further comprising a stabilizing means on the drill string to reduce contact of the drill string with the borehole wall except at the pad.

74. A method for stabilizing a borehole wall in an unconsolidated formation, the method comprising: providing a drill string; selecting the drill string to have a first bend angle and a second bend angle in an interval, the first bend angle being generated at a connection between an upper casing joint and a lower casing joint and the connection including a threaded coupling having a mill end box having a center axis and a field end box having a center axis and the mill end box center axis being angularly offset from the field end box center axis to form a coupling bend angle and the bend angle is controlled by selecting the coupling bend angle; and rotating the drill string to drive a drill bit to drill a borehole having the borehole wall; and driving the drill string against the borehole wall while rotating the drill string to plaster the surface of the borehole wall.

75. The method of claim 74 further comprising selecting the angular direction of the first bend angle.

76. The method of claim 74 wherein the connection defines an outer bend area on the drill string and the method further comprising providing wear protection at the outer bend area.

77. The method of claim 74 further comprising selecting the drill string to have a second bend angle in an interval.

78. The method of claim 77 wherein the directional orientation of the second bend angle is selected.

* * * * *